US008509644B2

(12) United States Patent
Takahashi et al.

(10) Patent No.: US 8,509,644 B2
(45) Date of Patent: Aug. 13, 2013

(54) FIXING DEVICE, IMAGE FORMING APPARATUS INCORPORATING SAME, AND FIXING METHOD

(75) Inventors: Yoshiharu Takahashi, Osaka (JP); Toshio Ogiso, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 13/195,241

(22) Filed: Aug. 1, 2011

(65) Prior Publication Data

US 2012/0045241 A1 Feb. 23, 2012

(30) Foreign Application Priority Data

Aug. 23, 2010 (JP) ..... 2010-186042
May 2, 2011 (JP) ..... 2011-102730

(51) Int. Cl.
*G03G 15/20* (2006.01)

(52) U.S. Cl.
USPC ..... 399/70

(58) Field of Classification Search
USPC ..... 399/69–70
See application file for complete search history.

(56) References Cited

U.S. PATENT DOCUMENTS 5,724,630 A * 3/1998 Mashiba ..... 399/70
6,782,231 B2 * 8/2004 Fuma et al. ..... 399/328
7,317,881 B2 * 1/2008 Hayashi ..... 399/70
7,395,003 B2 * 7/2008 Dan ..... 399/70
7,424,235 B2 * 9/2008 Mori et al. ..... 399/69
7,729,628 B2 * 6/2010 Nakayama ..... 399/69
7,769,332 B2 8/2010 Yamamoto et al.
7,831,186 B2 11/2010 Obata et al.
7,953,361 B2 5/2011 Obata et al.
8,032,046 B2 * 10/2011 Otsuka ..... 399/69
8,195,059 B2 * 6/2012 Shinshi ..... 399/69
8,295,753 B2 * 10/2012 Kagawa ..... 399/329
2009/0110418 A1 4/2009 Ogiso et al.
2009/0290893 A1 11/2009 Ogiso et al.

(Continued)

FOREIGN PATENT DOCUMENTS

JP 03223780 A * 10/1991
JP 2003-43836 2/2003
JP 2005-181779 7/2005
JP 2008-46576 2/2008

OTHER PUBLICATIONS

U.S. Appl. No. 12/929,321, filed Jan. 14, 2011, Unknown.
U.S. Appl. No. 13/067,907, filed Jul. 6, 2011, Unknown.

*Primary Examiner* — Clayton E LaBalle
*Assistant Examiner* — Leon W Rhodes, Jr.
(74) *Attorney, Agent, or Firm* — Oblon, Spivak, McClelland, Maier & Neustadt, L.L.P.

(57) ABSTRACT

A fixing device includes a temperature controller that controls a temperature of a fixing rotary body based on the temperature of the fixing rotary body detected by a temperature detector so as to heat the fixing rotary body to a plurality of preset target temperatures that includes a first target standby temperature, a target fixing temperature, a target idle temperature, and a second target standby temperature. When the target fixing temperature is lower than the first target standby temperature, the temperature controller separates a pressing rotary body from the fixing rotary body to idle the fixing rotary body for a predetermined idle time period before a fixing operation starts. After the fixing operation, the temperature controller controls a heater to change the temperature of the fixing rotary body to the second target standby temperature.

20 Claims, 8 Drawing Sheets

(56) References Cited

U.S. PATENT DOCUMENTS

2010/0034548 A1 2/2010 Naitoh et al.
2010/0054785 A1 3/2010 Ogiso et al.
2011/0064441 A1* 3/2011 Morihara ..... 399/69
2012/0027477 A1* 2/2012 Nakayama ..... 399/328

* cited by examiner

FIXING DEVICE, IMAGE FORMING APPARATUS INCORPORATING SAME, AND FIXING METHOD

CROSS-REFERENCE TO RELATED APPLICATIONS

The present application is based on and claims priority to Japanese Patent Application Nos. 2010-186042, filed on Aug. 23, 2010, and 2011-102730, filed on May 2, 2011, in the Japan Patent Office, which are hereby incorporated herein by reference in their entirety.

BACKGROUND OF THE INVENTION

1. Field of the Invention

Exemplary aspects of the present invention relate to a fixing device, an image forming apparatus, and a fixing method, and more particularly, to a fixing device for fixing a toner image on a recording medium, an image forming apparatus including the fixing device, and a fixing method for fixing a toner image on a recording medium.

2. Description of the Related Art

Related-art image forming apparatuses, such as copiers, facsimile machines, printers, or multifunction printers having at least one of copying, printing, scanning, and facsimile functions, typically foam an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing roller and a pressing roller pressed against the fixing roller to form a nip therebetween through which the recording medium bearing the toner image passes. As the recording medium passes through the nip, the fixing roller heated by a heater and the pressing roller together apply heat and pressure to the recording medium, thus melting and fixing the toner image on the recording medium.

FIGS. 1 and 2 are schematic vertical sectionals of a fixing device 15R having the above-described configuration. As illustrated in FIG. 1, a pressing roller 61 is pressed against a fixing roller 63 heated by a heater 62. As a recording medium 69 bearing a toner image passes through a nip N formed between the pressing roller 61 and the fixing roller 63, the toner image is fixed on the recording medium 69 by heat and pressure from the fixing roller 63 and the pressing roller 61.

If the fixing roller 63 overheats the recording medium 69, moisture contained in the recording medium 69 is vaporized, causing two related problems. A first problem is adherence of water droplets to the unfixed toner image on the recording medium 69, producing a spotty or other faulty toner image. A second problem is a weakening of the rigidity of the recording medium 69, causing the recording medium 69 to warp and producing a distorted or other faulty toner image.

The first problem of adhering water droplets to the unfixed toner image on the recording medium 69 arises when vaporized moisture adhering to the interior of the fixing device 15R moves to the unfixed toner image on the recording medium 69. Several solutions to this problem have been proposed, such as employing hygroscopic materials in the components disposed in proximity to the path along which the recording medium 69 is conveyed (recording medium conveyance path), passing a blank sheet through the nip N formed between the fixing roller 63 and the pressing roller 61 before the fixing operation to absorb water droplets, driving a heater and a fan based on the temperature and humidity measured inside and outside the image foaming apparatus, and installing a dehumidifier heater in a paper tray that stores recording media to be supplied to the fixing device. However, such solutions increase both the number of parts and consumption of blank sheets and power, resulting in increased manufacturing costs and upsizing of the image forming apparatus while adverse affecting the environment.

The second problem of warping the recording medium arises when the recording medium loses its rigidity due to vaporization of moisture contained therein. For example, as shown in FIGS. 1 and 2, a guide assembly 60 constructed of an exit guide 41, a swing guide 42, and a conveyance guide 43 may be disposed downstream from the fixing device 15R and upstream from an output roller pair 45 in the conveyance direction of the recording medium 69. As shown in FIG. 1, the rigid recording medium 69 conveyed from the nip N formed between the pressing roller 61 and the fixing roller 63 to the output roller pair 45 contacts the swing guide 42 and is guided by the swing guide 42 to the output roller pair 45 without being warped. By contrast, as shown in FIG. 2, the recording medium 69 with a decreased rigidity due to vaporization of moisture contained therein may be warped toward the pressing roller 61 when discharged from the nip N, and then may strike the exit guide 41 and the swing guide 42 in a state in which the leading edge of the recording medium 69 is nipped and pulled by the output roller pair 45, thus warping the recording medium 69. When the fixing roller 63 and the pressing roller 61 apply heat and pressure to the unfixed toner image on the warped recording medium 69, the toner image may be distorted.

Referring to FIG. 3, a detailed description is now given of the mechanism whereby vaporization of moisture contained in the recording medium 69 takes place.

FIG. 3 is a timing chart showing a temperature waveform T of a known method of controlling the temperature of the fixing roller 63. The image forming apparatus may provide a high definition mode that forms a high definition toner image by heating the toner image on the recording medium 69 conveyed through the nip N for a longer time at a decreased speed. Since the fixing roller 63 heats the toner image for the longer time, the toner image needs to be fixed at a temperature of the fixing roller 63 that is equivalent to a target fixing temperature T1 lower than a target standby temperature T0. However, if the fixing operation starts before the temperature of the fixing roller 63 decreases from the target standby temperature T0 to the target fixing temperature T1, the fixing roller 63 overheats the recording medium 69, vaporizing the moisture contained in the recording medium 69. For the reasons described above such vaporization is undesirable, and accordingly, there is a need for a technology to prevent vaporization of moisture from the recording medium 69.

BRIEF SUMMARY OF THE INVENTION

This specification describes below an improved fixing device. In one exemplary embodiment of the present invention, the fixing device performs a fixing operation of fixing a toner image on a recording medium, and includes a fixing rotary body, a pressing rotary body, a temperature detector, and a temperature controller. The fixing rotary body is heated by a heater. The pressing rotary body is separatably pressed against the fixing rotary body to form a nip therebetween through which the recording medium bearing the toner image passes. The temperature detector is disposed opposite the fixing rotary body to detect a temperature of the fixing rotary body. The temperature controller is connected to the temperature detector, the heater, and the pressing rotary body to control the temperature of the fixing rotary body based on the temperature of the fixing rotary body detected by the temperature detector so as to heat the fixing rotary body to a plurality of preset target temperatures that includes a first target standby temperature, a target fixing temperature, a target idle temperature, and a second target standby temperature. When the target fixing temperature is lower than the first target standby temperature, the temperature controller separates the pressing rotary body from the fixing rotary body to idle the fixing rotary body for a predetermined idle time period before the fixing operation starts. After the fixing operation, the temperature controller controls the heater to change the temperature of the fixing rotary body to the second target standby temperature.

This specification further describes an improved image forming apparatus. In one exemplary embodiment, the image forming apparatus includes the fixing device described above.

This specification further describes an improved fixing method for performing a fixing operation of fixing a toner image on a recording medium. The method includes rotating a pressing rotary body and pressing the pressing rotary body against a fixing rotary body to form a nip therebetween through which the recording medium bearing the toner image passes; heating the fixing rotary body to a first target standby temperature; accepting a first fixing job of a high definition mode that forms a high definition toner image on the recording medium; separating the pressing rotary body from the fixing rotary body to idle the fixing rotary body for a predetermined idle time period until a temperature of the fixing rotary body decreases to a target idle temperature; pressing the pressing rotary body against the fixing rotary body when the temperature of the fixing rotary body reaches the target idle temperature; passing the recording medium bearing the toner image through the nip to fix the toner image on the recording medium at a target fixing temperature; changing the temperature of the fixing rotary body to a second target standby temperature; and increasing the temperature of the fixing rotary body to the first target standby temperature if the fixing device does not accept a second fixing job within a predetermined time period.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
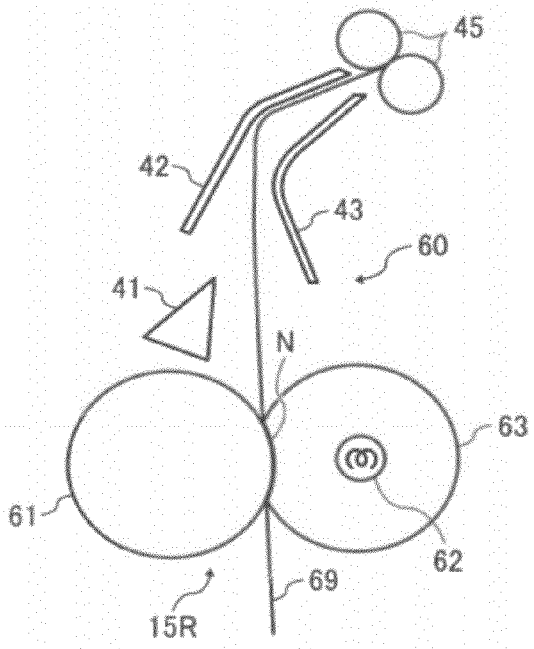
FIG. 1 RELATED ART
FIG. 1 is a vertical sectional view of a related-art fixing device in a state in which a recording medium is discharged from the fixing device properly.
Figure 2:
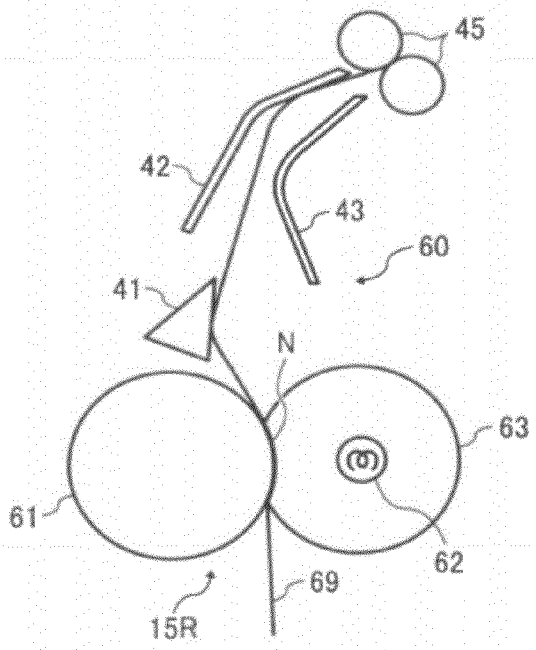
FIG. 2 RELATED ART
FIG. 2 is a vertical sectional view of the related-art fixing device shown in FIG. 1 in a state in which the recording medium is warped and therefore is not discharged from the fixing device properly.
Figure 3:
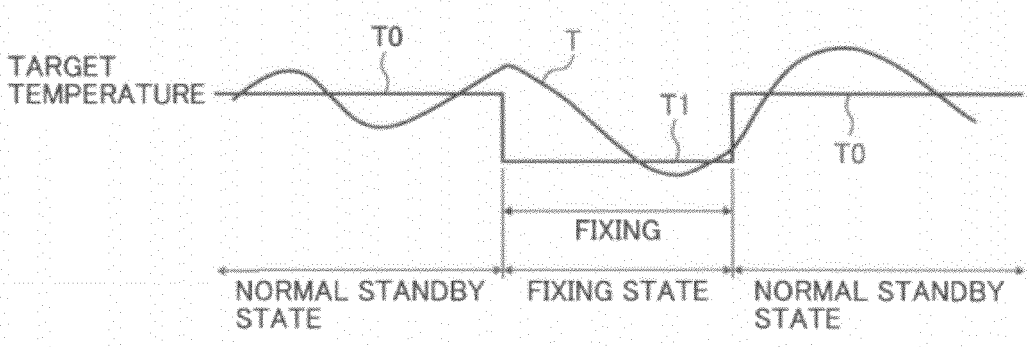
FIG. 3 RELATED ART
FIG. 3 is a timing chart showing a temperature waveform of a control method employed in the related-art fixing device shown in FIG. 1.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 4:
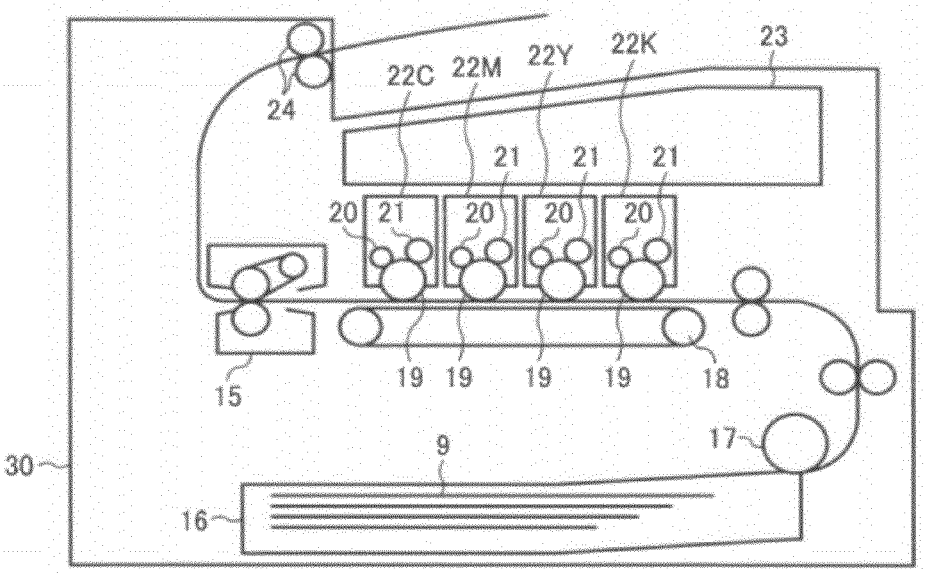
FIG. 4 is a schematic view of an image forming apparatus according to an exemplary embodiment of the present invention.

Referring now to the drawings, wherein like reference numerals designate identical or corresponding parts throughout the several views, in particular to FIG. 4, an image forming apparatus 30 according to an exemplary embodiment of the present invention is explained.

FIG. 4 is a schematic view of the image forming apparatus 30. As illustrated in FIG. 4, the image forming apparatus 30 may be a copier, a facsimile machine, a printer, a multifunction printer having at least one of copying, printing, scanning, plotter, and facsimile functions, or the like. According to this exemplary embodiment, the image forming apparatus 30 is a printer for forming a color image on a recording medium by electrophotography. Referring to FIG. 4, the following describes the structure of the image forming apparatus 30.

Referring to FIG. 4, a detailed description is now given of the structure of the image forming apparatus 30. As illustrated in FIG. 4, the image forming apparatus 30 includes a transfer belt unit 18 disposed in a center portion of the image forming apparatus 30 and four image forming units 22K, 22Y, 22M, and 22C disposed above the transfer belt unit 18. Each of the image forming units 22K, 22Y, 22M, and 22C includes a photoconductor 19, a charging roller 20, and a development roller 21, which are integrated into a unit containing toner.

Above the image forming units 22K, 22Y, 22M, and 22C is an exposure device 23 that emits a light beam onto a surface of the photoconductor 19 charged by the charging roller 20 of the respective image foaming units 22K, 22Y, 22M, and 22C to form an electrostatic latent image on the photoconductor 19 so that the development roller 21 develops the electrostatic latent image into a toner image. Below the transfer belt unit 18 in a lower portion of the image foaming apparatus 30 is a sheet tray 16 that loads a plurality of sheets 9 serving as recording media and a sheet feeder 17 that picks up and feeds an uppermost sheet 9 of the plurality of sheets 9 loaded on the sheet tray 16 toward the transfer belt unit 18 that transfers the toner image formed on the photoconductor 19 of the respective image forming units 22K, 22Y, 22M, and 22C onto the sheet 9. Downstream from the transfer belt unit 18 in a conveyance direction of the sheet 9 is a fixing device 15 that fixes the toner image on the sheet 9 and an output roller pair 24 that discharges the sheet 9 bearing the fixed toner image sent from the fixing device 15 to an outside of the image forming apparatus 30.

Referring to FIG. 4, a detailed description is now given of the operation of the image foaming apparatus 30 having the above-described structure.

The charging roller 20 of the respective image forming units 22K, 22Y, 22M, and 22C uniformly charges the surface of the photoconductor 19. The exposure device 23 exposes the charged surface of the photoconductor 19 with a light beam according to image data per dot sent from a client computer, thus forming an electrostatic latent image on the surface of the photoconductor 19. Thereafter, the development roller 21 supplies toner to the electrostatic latent image formed on the photoconductor 19, visualizing the electrostatic latent image as a visible toner image.

As the toner image is formed on the photoconductor 19, the sheet feeder 17 feeds a sheet 9 from the sheet tray 16 to the transfer belt unit 18. As the sheet 9 conveyed on the transfer belt unit 18 contacts the four photoconductors 19 of the image forming units 22K, 22Y, 22M, and 22C successively, the respective toner images, that is, black, yellow, magenta, and cyan toner images, formed on the photoconductors 19 of the image forming units 22K, 22Y, 22M, and 22C are transferred onto the sheet 9 on the transfer belt unit 18. Thus, the black, yellow, magenta, and cyan toner images are superimposed on the sheet 9, producing a color toner image on the sheet 9. The sheet 9 bearing the color toner image is sent from the transfer belt unit 18 to the fixing device 15 where the color toner image is fixed on the sheet 9. Thereafter, the sheet 9 bearing the fixed color toner image is sent to the output roller pair 24. Then, the output roller pair 24 discharges the sheet 9 onto the outside of the image forming apparatus 30.

Figure 5:
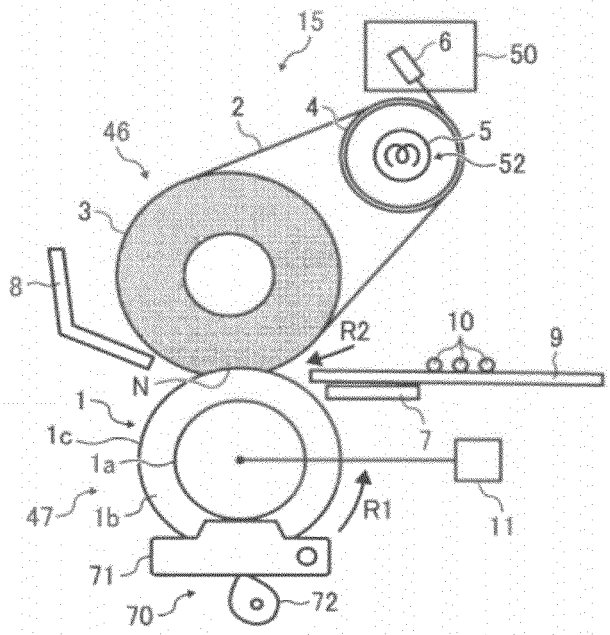
FIG. 5 is a vertical sectional view of a fixing device included in the image forming apparatus shown in FIG. 4.

Referring to FIG. 5, the following describes the structure of the fixing device 15 installed in the image forming apparatus 30 described above.

FIG. 5 is a vertical sectional view of the fixing device 15. As illustrated in FIG. 5, the fixing device 15 (e.g., a fuser unit) includes a fixing assembly 46 and a pressing assembly 47 pressed against the fixing assembly 46. The fixing assembly 46 includes a heating roller 4 inside which a heater 52, that is, a heat source, is disposed, a fixing roller 3, and a fixing belt 2 stretched over the heating roller 4 and the fixing roller 3.

The pressing assembly 47 includes a pressing roller 1. For example, the pressing roller 1 is pressed by a moving assembly 70 against the fixing roller 3 via the fixing belt 2 to form a nip N between the pressing roller 1 and the fixing belt 2. The moving assembly 70 includes a lever 71 contacting the pressing roller 1 and a cam 72 contacting the lever 71. As the cam 72 rotates, it moves the lever 71 toward and away from the pressing roller 1. Accordingly, as the cam 72 moves the lever 71 toward the pressing roller 1, the pressing roller 1 is pressed against the fixing roller 3 via the fixing belt 2. Conversely, as the cam 72 moves the lever 71 away from the pressing roller 1, the pressing roller 1 is separated from the fixing belt 2. It should be noted that the structure of the moving assembly 70 is not limited to that shown in FIG. 5. For example, the moving assembly 70 may include a lever, a cam contacting the lever, and a spring, attached to the lever, that biases the lever.

The pressing roller 1 is constructed of three layers: a metal core 1*a*, an elastic layer 1*b* covering the metal core 1*a*, and a surface release layer 1*c* covering the elastic layer 1*b*. For example, the metal core 1*a* is made of carbon steel having a thickness of about 4.5 mm and a loop diameter of about 23.0 mm. The elastic layer 1*b* is made of silicone rubber having a thickness of about 3.5 mm. The release layer 1*c* is made of tetrafluoroethylene-perfluoroalkylvinylether copolymer (PFA) having a thickness of about 30 micrometers. The pressing roller 1 presses a sheet 9 passing through the nip N against the fixing belt 2 and is rotated by a driver 11 (e.g., a motor) in a rotation direction R1, thus rotating the fixing belt 2 in a rotation direction R2 counter to the rotation direction R1 of the pressing roller 1.

The fixing belt 2 may be constructed of three layers: a polyimide base layer, an elastic layer covering the base layer, and a surface release layer covering the elastic layer. The polyimide base layer has an endless belt shape having a thickness of about 70 micrometers and, in its operational looped shape, an outer loop diameter of about 45.0 mm. The elastic layer is disposed on a surface of the polyimide base layer to enhance and stabilize quality of a toner image 10 formed on the sheet 9. The elastic layer may be made of silicone rubber having a thickness of about 150 micrometers. The release layer is disposed on the elastic layer to facilitate separation of the toner image 10 on the sheet 9 from the fixing belt 2. The release layer is made of PFA having a thickness of about 30 micrometers, for example.

The fixing roller 3 is disposed opposite the pressing roller 1 via the fixing belt 2 to form the nip N where the toner image 10 is fixed on the sheet 9 by heat and pressure applied by the fixing belt 2 and the pressing roller 1. Upstream from the nip N in the conveyance direction of the sheet 9 is an entry guide 7 that guides the sheet 9 sent from the transfer belt unit 18 depicted in FIG. 4 to the nip N. Conversely, downstream from the nip N in the conveyance direction of the sheet 9 is an exit guide 8 that guides the sheet 9 discharged from the nip N toward the output roller pair 24 depicted in FIG. 4.

The heating roller 4, that is, a hollow roller made of a metal such as aluminum and/or iron, for example, rotatably supports the fixing belt 2. With the fixing belt 2 wound around the heating roller 4 over an outer circumferential surface area thereof by at least 100 degrees, the heating roller 4 rotates the fixing belt 2 stably. Inside the heating roller 4 is the heater 52, serving as a heat source, that includes a halogen heater 5. The heater 52 is connected to a controller 50 that controls at least the fixing assembly 46, the heater 52, the pressing roller 1, the moving assembly 70, and the driver 11 described above.

Figure 6:
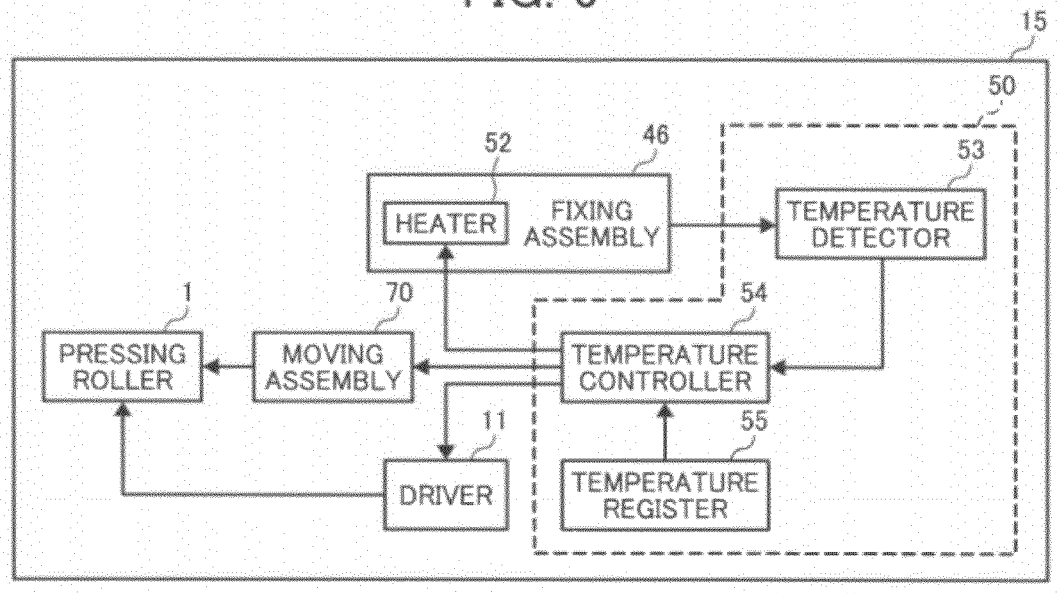
FIG. 6 is a block diagram of a controller included in the fixing device shown in FIG. 5.

FIG. 6 is a block diagram of the controller 50. As illustrated in FIG. 6, the controller 50 is a central processing unit (CPU) provided with a random-access memory (RAM) and a read-only memory (ROM), for example, and includes a temperature detector 53 that detects a temperature of the fixing assembly 46 and a temperature controller 54 that controls the temperature of the fixing assembly 46 to a target temperature based on the temperature of the fixing assembly 46 detected by the temperature detector 53. As shown in FIG. 5, the temperature detector 53 includes a thermistor 6 that detects a temperature of the heating roller 4 via the fixing belt 2. For example, the halogen heater 5 of the heater 52 is connected to a control board of the controller 50 via wiring such as a harness. The temperature controller 54 controls the halogen heater 5 to adjust a temperature of the fixing belt 2 of the fixing assembly 46. Thus, the fixing belt 2 supplies thermal energy to the sheet 9 which is necessary to fix the toner image 10 on the sheet 9.

The thermistor 6 is a temperature sensor that measures the temperature of the fixing assembly 46 by using the principle of electrical resistance of a metal oxide semiconductor and the like that changes depending on temperature. That is, the thermistor 6 is a responsive device downsized and manufactured at reduced costs. Thermistors can be classified into two types: Negative Temperature Coefficient (NTC) thermistors that exhibit decreasing electrical resistance with increases in environmental temperature, and Positive Temperature Coefficient (PTC) thermistors that exhibit increasing electrical resistance with increases in environmental temperature. The temperature controller 54 is a micro computer, for example.

Before the temperature controller 54 conducts temperature control, a temperature register 55 presets a target fixing temperature and a target normal standby temperature. The target fixing temperature defines a target temperature of the fixing assembly 46 depicted in FIG. 5 in a fixing state in which the fixing belt 2 and the pressing roller 1 apply heat and pressure to the sheet 9 to fix the toner image 10 on the sheet 9. By contrast, the target normal standby temperature defines a target temperature of the fixing assembly 46 in a normal standby state in which the fixing assembly 46 is warmed up and is in a standby mode waiting for a fixing job before the fixing device 15 enters the fixing state.

Since the pressing roller 1 driven by the driver 11 rotates the fixing belt 2, a rotation speed of the fixing belt 2 can be adjusted by changing a rotation speed of the pressing roller 1. Further, when the pressing roller 1 pressed against the fixing roller 3 is separated from the fixing belt 2, the fixing assembly 46 constructed of the fixing belt 2, the fixing roller 3, and the heating roller 4 is idled. Specifically, as the temperature controller 54 connected to the moving assembly 70 moves the moving assembly 70 away from the pressing roller 1, the pressing roller 1 separates from the fixing belt 2.

Referring to FIGS. 7 to 11, the following describes two methods of controlling the temperature of the fixing assembly 46 of the fixing device 15 depicted in FIG. 5.

Figure 7:
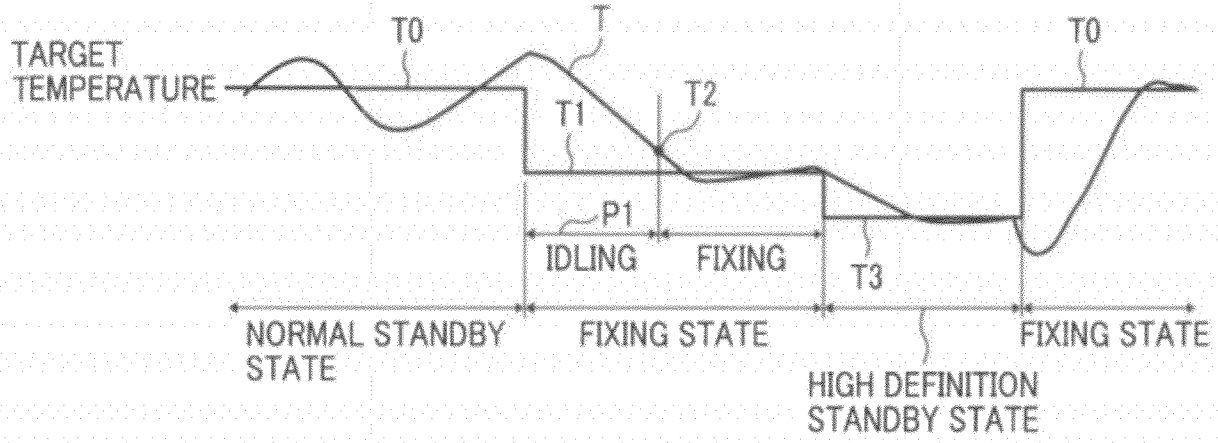
FIG. 7 is a timing chart showing a temperature waveform of a first control method performed by the controller shown in FIG. 6.
Figure 8:
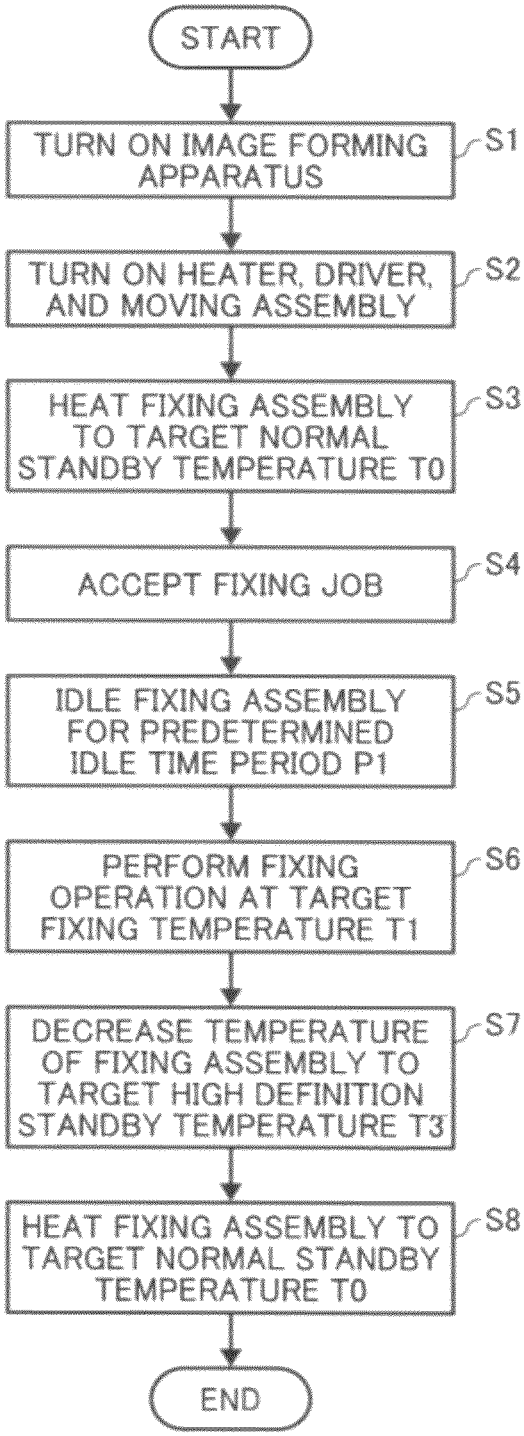
FIG. 8 is a flowchart showing processes of the first control method shown in FIG. 7.
Figure 9:
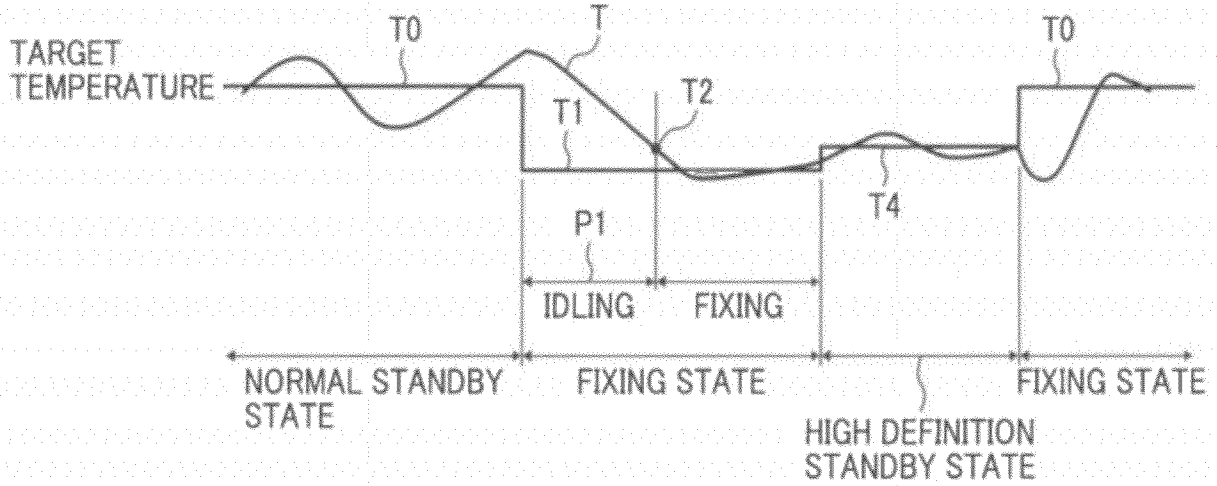
FIG. 9 is a timing chart showing a temperature waveform of a second control method performed by the controller shown in FIG. 6.
Figure 10:
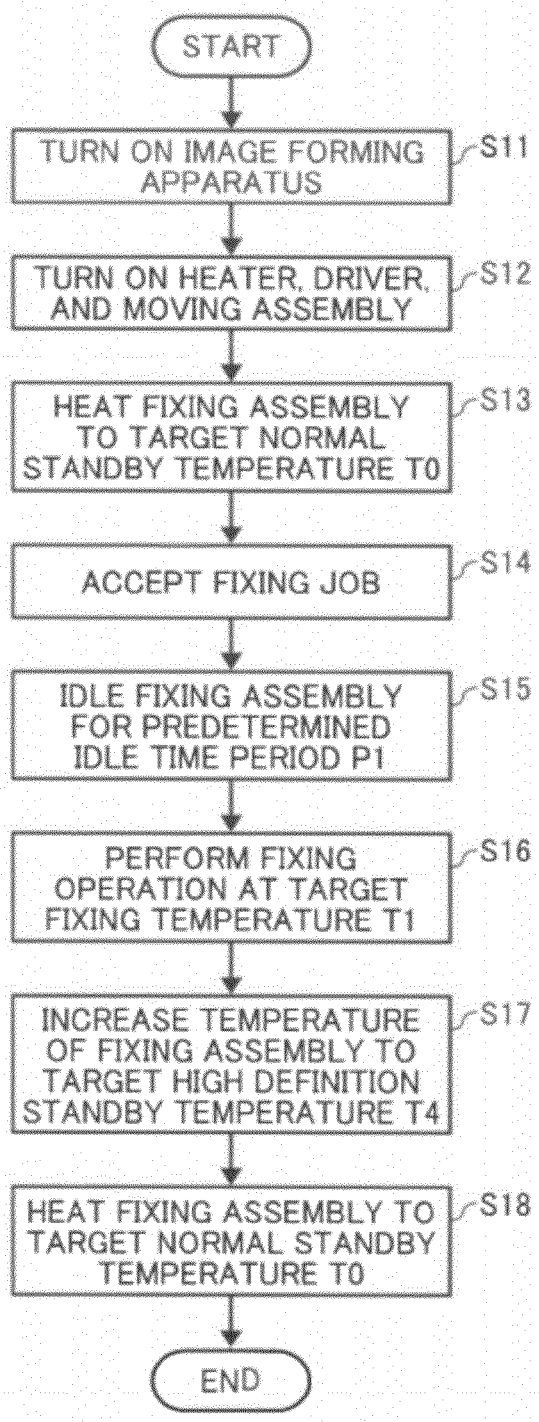
FIG. 10 is a flowchart showing processes of the second control method shown in FIG. 9.
Figure 11:
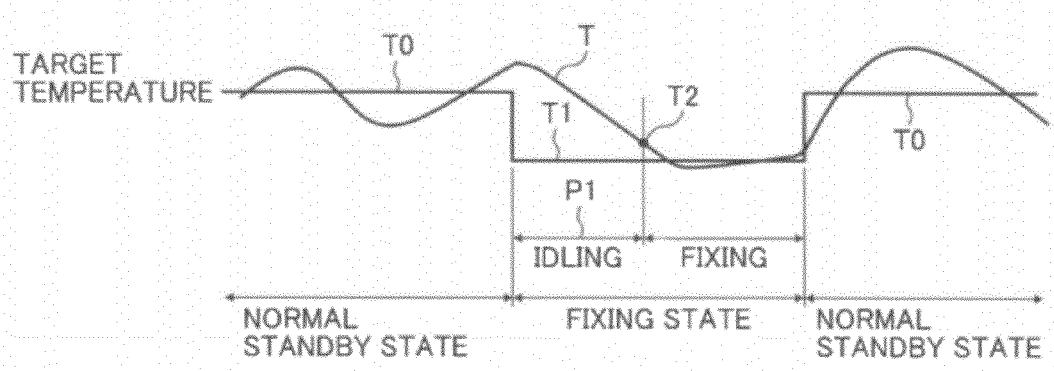
FIG. 11 is a timing chart showing a temperature waveform of a comparative control method.

FIG. 7 is a timing chart showing a temperature waveform T of a first control method of controlling the temperature of the fixing assembly 46. FIG. 8 is a flowchart showing the processes of the first control method. FIG. 9 is a timing chart showing a temperature waveform T of a second control method of controlling the temperature of the fixing assembly 46. FIG. 10 is a flowchart showing the processes of the second control method. FIG. 11 is a timing chart showing a temperature waveform T of a comparative control method of controlling the temperature of the fixing assembly 46.

The image forming apparatus 30 depicted in FIG. 4 provides a high definition mode that forms a high definition toner image on a sheet 9 by heating the unfixed toner image 10 on the sheet 9 for a longer time, compared to a normal mode that forms a normal definition toner image, by conveying the sheet 9 through the nip N at a decreased conveyance speed. Since the fixing assembly 46 heats the sheet 9 for the longer time in the high definition mode, a target fixing temperature T1 at which the fixing assembly 46 fixes the toner image 10 on the sheet 9 is lower than a target normal standby temperature T0 as shown in FIG. 11 so that the fixing assembly 46 does not overheat the sheet 9, thus preventing vaporization of moisture contained in the sheet 9. For example, in the present embodiment, the target normal standby temperature T0 is 170 degrees centigrade and the target fixing temperature T1 is 155 degrees centigrade. In order to decrease the temperature of the fixing assembly 46 from the target normal standby temperature T0 to the target fixing temperature T1, the fixing assembly 46 idles for a predetermined idle time period P1 before a fixing operation starts.

Referring to FIG. 7, a detailed description is now given of the temperature waveform T of the first control method of controlling the temperature of the fixing assembly 46.

According to this exemplary embodiment, the fixing assembly 46 idles for the predetermined idle time period P1 before the fixing device 15 starts a fixing operation after the normal standby state. For example, the temperature register 55 depicted in FIG. 6 presets the target fixing temperature T1 and the target normal standby temperature T0. The target normal standby temperature T0 is determined based on the target fixing temperature T1 at which a monochrome toner image is fixed on plain paper, that is, a sheet 9 having a paper weight in a range of from about 66 g/m$^2$ to about 74 g/m$^2$. Accordingly, the target normal standby temperature T0 is higher than the target fixing temperature T1. In this case, the target normal standby temperature T0 is 170 degrees centigrade and the target fixing temperature T1 is 155 degrees centigrade. The target fixing temperature T1 is changed according to a thickness (e.g., paper weight) of a sheet 9, an image forming mode selected by a user (e.g., the high definition mode or the normal mode; a monochrome image mode or a color image mode), and a fixing speed. For example, as the thickness of the sheet 9 increases, the target fixing temperature T1 increases. Conversely, as the thickness of the sheet 9 decreases, the target fixing temperature T1 decreases.

As shown in FIG. 7, as the fixing device 15 transits from the normal standby state to the fixing state, the fixing assembly 46 idles for the predetermined idle time period P1 initially in the fixing state. As shown by the temperature waveform T detected by the temperature detector 53 depicted in FIG. 6, while the fixing assembly 46 idles for the predetermined idle time period P1, the temperature of the fixing assembly 46 detected by the temperature detector 53 decreases. By the time the fixing device 15 starts the fixing operation after idling of the fixing assembly 46 is finished, the temperature of the fixing assembly 46 reaches substantially the target fixing temperature T1.

After the fixing operation is finished, the fixing device 15 enters a high definition standby state following the fixing state, in which the temperature of the fixing assembly 46 is targeted at a target high definition standby temperature T3, which is also preset by the temperature resistor 55 depicted in FIG. 6, lower than the target fixing temperature T1. If the high definition mode is selected, the fixing device 15 does not resume the normal standby state immediately after the fixing operation is finished but instead enters the high definition standby state defining the target high definition standby temperature T3 different from the target normal standby temperature T0. The high definition standby state is maintained until the fixing device 15 receives a next fixing job of the normal mode.

If two consecutive fixing jobs are performed in the high definition mode, for example, if the user wants to print a modified image on another sheet 9, according to the comparative control method shown in FIG. 11, the temperature of the fixing assembly 46 may be increased to the target normal standby temperature T0 after the fixing operation of the first fixing job is finished, and then the fixing assembly 46 may idle again immediately before the fixing operation of the second fixing job as shown in FIG. 11. With this control method, however, the temperature of the fixing assembly 46 needs to be decreased to a target temperature of the high definition mode, that is, the target high definition standby temperature T3 depicted in FIG. 7, to perform the fixing operation of the high definition mode, resulting in unnecessary temperature adjustment involving increasing and decreasing the temperature of the fixing assembly 46. That is, energy is unnecessarily consumed to increase and decrease the temperature of the fixing assembly 46. Such waste of power increases power costs and adversely affects the environment. Moreover, increasing and decreasing the temperature of the fixing assembly 46 wastes time, degrading usability of the fixing device 15.

To address these problems, according to this exemplary embodiment as shown in FIG. 7, the fixing device 15 retains the high definition standby state until it receives the next fixing job of the normal mode, thus eliminating unnecessary increasing and decreasing of the temperature of the fixing assembly 46. Specifically, the temperature of the fixing assembly 46 is maintained at the target high definition standby temperature T3 for a predetermined time period after the fixing operation of the high definition mode is finished. If the fixing device 15 does not receive the next fixing job of the high definition mode even when the predetermined time period elapses in the high definition standby state after the fixing operation is finished, the temperature of the fixing assembly 46 increases from the target high definition standby temperature T3 to the target normal standby temperature T0. It is to be noted that, if the fixing device 15 accepts the next fixing job of the normal mode within the predetermined time period, the temperature of the fixing assembly 46 increases from the target high definition standby temperature T3 to a higher target fixing temperature of the normal mode. By contrast, if the fixing device 15 accepts the next fixing job of the high definition mode within the predetermined time period, the temperature of the fixing assembly 46 increases from the target high definition standby temperature T3 to the target fixing temperature T1 of the high definition mode.

Referring to FIG. 8, the following describes the processes of the first control method described above by referring to FIG. 7.

As illustrated in FIG. 8, in step S1, the image forming apparatus 30 is turned on.

In step S2, the temperature controller 54 turns on the heater 52 to heat the fixing assembly 46, drives the driver 11 to rotate the pressing roller 1, and moves the moving assembly 70 to press the pressing roller 1 against the fixing assembly 46.

In step S3, the temperature controller 54 causes the heater 52 to heat the fixing assembly 46 to the target normal standby temperature T0 in the normal standby state.

In step S4, the fixing device 15 accepts a fixing job of the high definition mode as a part of a print request sent to the image forming apparatus 30 from the client computer.

In step S5, the temperature controller 54 moves the moving assembly 70 to separate the pressing roller 1 from the fixing assembly 46 so as to idle the fixing assembly 46 for the predetermined idle time period P1 until the temperature of the fixing assembly 46 decreases to a target idle temperature T2 which is lower than the target normal standby temperature T0 and higher than the target fixing temperature T1.

In step S6, after the predetermined idle time period P1 elapses, the temperature controller 54 moves the moving assembly 70 to press the pressing roller 1 against the fixing assembly 46 to perform the fixing operation of the high definition mode, that is, the fixing assembly 46 and the pressing roller 1 apply heat and pressure to the sheet 9 to fix the toner image 10 on the sheet 9 at the target fixing temperature T1.

In step S7, after the fixing operation is finished, that is, after the temperature controller 54 detects that the fixing operation is finished based on a detection signal sent from a sensor that detects the sheet 9 discharged from the nip N of the fixing device 15, for example, the temperature controller 54 causes the heater 52 to decrease the temperature of the fixing assembly 46 to the target high definition standby temperature T3 lower than the target fixing temperature T1 in the high definition standby state. Thus, the fixing device 15 waits for the next fixing job of the high definition mode for a predetermined time period at the target high definition standby temperature T3 of the fixing assembly 46.

In step S8, when the fixing device 15 does not receive the next fixing job of the high definition mode even after the predetermined time period elapses, the temperature controller 54 causes the heater 52 to heat the fixing assembly 46 to the target normal standby temperature T0.

Referring to FIG. 9, a detailed description is now given of the temperature waveform T of the second control method of controlling the temperature of the fixing assembly 46.

Like the first control method shown in FIG. 7, the second control method shown in FIG. 9 performs the fixing operation of the high definition mode after the fixing assembly 46 is idled. Thereafter, the fixing device 15 enters the high definition standby state at a target high definition standby temperature T4 higher than the target fixing temperature T1 and lower than the target normal standby temperature T0. Thus, after the fixing operation of the high definition mode, the fixing device 15 enters the high definition standby state at the target high definition standby temperature T4 higher than the target fixing temperature T1 and lower than the target normal standby temperature T0. Specifically, the temperature of the fixing assembly 46 is maintained at the target high definition standby temperature T4 for a predetermined time period after the fixing operation is finished. If the fixing device 15 does not receive the next fixing job of the high definition mode even when the predetermined time period elapses in the high definition standby state after the fixing operation is finished, the temperature of the fixing assembly 46 increases from the target high definition standby temperature T4 to the target normal standby temperature T0. It is to be noted that, if the fixing device 15 accepts the next fixing job of the normal mode within the predetermined time period, the temperature of the fixing assembly 46 increases from the target high definition standby temperature T4 to a higher target fixing temperature of the normal mode. By contrast, if the fixing device 15 accepts the next fixing job of the high definition mode within the predetermined time period, the temperature of the fixing assembly 46 increases from the target high definition standby temperature T4 to the target fixing temperature T1 of the high definition mode.

Referring to FIG. 10, the following describes the processes of the second control method described above by referring to FIG. 9.

As illustrated in FIG. 10, in step S11, the image forming apparatus 30 is turned on.

In step S12, the temperature controller 54 turns on the heater 52 to heat the fixing assembly 46, drives the driver 11 to rotate the pressing roller 1, and moves the moving assembly 70 to press the pressing roller 1 against the fixing assembly 46.

In step S13, the temperature controller 54 causes the heater 52 to heat the fixing assembly 46 to the target normal standby temperature T0 in the normal standby state.

In step S14, the fixing device 15 accepts a fixing job of the high definition mode as a part of a print request sent to the image forming apparatus 30 from the client computer.

In step S15, the temperature controller 54 moves the moving assembly 70 to separate the pressing roller 1 from the fixing assembly 46 so as to idle the fixing assembly 46 for the predetermined idle time period P1 until the temperature of the fixing assembly 46 decreases to the target idle temperature T2 which is lower than the target normal standby temperature T0 and higher than the target fixing temperature T1.

In step S16, after the predetermined idle time period P1 elapses, the temperature controller 54 moves the moving assembly 70 to press the pressing roller 1 against the fixing assembly 46 to perform the fixing operation of the high definition mode, that is, the fixing assembly 46 and the pressing roller 1 apply heat and pressure to the sheet 9 to fix the toner image 10 on the sheet 9 at the target fixing temperature T1.

In step S17, after the fixing operation is finished, that is, after the temperature controller 54 detects that the fixing operation is finished based on a detection signal sent from a sensor that detects the sheet 9 discharged from the nip N of the fixing device 15, for example, the temperature controller 54 causes the heater 52 to increase the temperature of the fixing assembly 46 to the target high definition standby temperature T4 higher than the target fixing temperature T1 in the high definition standby state. Thus, the fixing device 15 waits for the next fixing job of the high definition mode for a predetermined time period at the target high definition standby temperature T4 of the fixing assembly 46.

In step S18, when the fixing device 15 does not receive the next fixing job of the high definition mode even after the predetermined time period elapses, the temperature controller 54 causes the heater 52 to heat the fixing assembly 46 to the target normal standby temperature T0.

With the second control method shown in FIG. 9 described above in which the target high definition standby temperature T4 is lower than the target normal standby temperature T0 and higher than the target fixing temperature T1, even when the fixing device 15 receives the next fixing job of the high definition mode, the fixing assembly 46, with the target high definition standby temperature T4 lower than the target normal standby temperature T0, idles for a reduced time period. Further, if the high definition standby temperature T4 is set to a temperature identical to the target idle temperature T2, the fixing assembly 46 idles for a minimum time period. Moreover, with the second control method shown in FIG. 9, the target high definition standby temperature T4 is set to a temperature higher than the target fixing temperature T1 of the high definition mode. Thus, even when the fixing device 15 receives the next fixing job of the normal mode, the temperature of the fixing assembly 46 reaches the target fixing temperature of the normal mode within a reduced time period, shortening fixing operation time of the fixing device 15.

It is to be noted that the predetermined idle time period P1 shown in FIGS. 7 and 9 may be arbitrarily set so that the temperature of the fixing assembly 46 detected by the temperature detector 53 reaches the preset target fixing temperature T1 or a value approximate to the preset target fixing temperature T1.

Further, the target high definition standby temperature T3 shown in FIG. 7, that is, a reference standby temperature of the high definition mode, may be changed within a range that does not necessitate decreasing of the temperature of the fixing assembly 46 by idling the fixing assembly 46 after the temperature of the fixing assembly 46 is increased to the target normal standby temperature T0.

The target high definition standby temperature T4 shown in FIG. 9, that is, a reference standby temperature of the high definition mode, may be changed within a range that reduces the predetermined idle time period P1 even when the fixing device 15 receives the next fixing job of the high definition mode.

Figure 12:
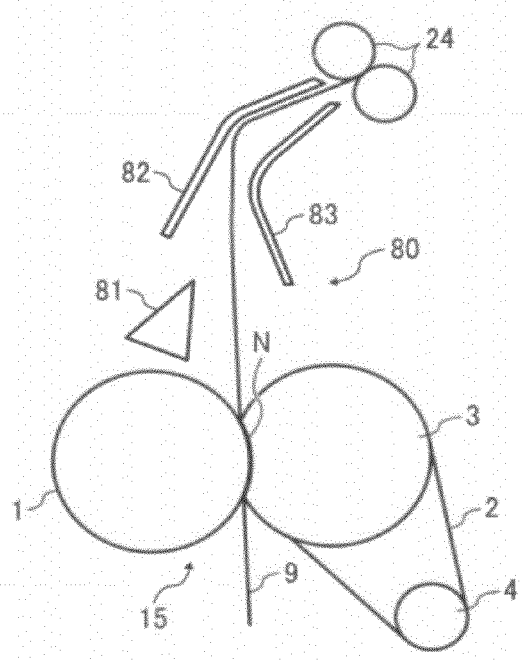
FIG. 12 is a vertical sectional view of the fixing device shown in FIG. 5, a guide assembly, and an output roller pair included in the image forming apparatus shown in FIG. 4.

In order to prevent warping of the sheet 9 more precisely, it is preferable to locate a guide assembly 80 that guides the sheet 9 discharged from the fixing device 15 to the output roller pair 24. Referring to FIG. 12, a detailed description is now given of the guide assembly 80. FIG. 12 is a vertical sectional view of the fixing device 15, the guide assembly 80, and the output roller pair 24. As illustrated in FIG. 12, the guide assembly 80 is disposed downstream from the fixing device 15 and upstream from the output roller pair 24 in the conveyance direction of the sheet 9. The guide assembly 80 includes an exit guide 81 (e.g., a wedge) disposed in proximity to the exit of the nip N; and a swing guide 82 and a conveyance guide 83 (e.g., plates) disposed downstream from the exit guide 81 in the conveyance direction of the sheet 9.

The exit guide 81 guides the sheet 9 discharged from the nip N to the swing guide 82 and the conveyance guide 83 disposed opposite each other to further guide the sheet 9 to the output roller pair 24 disposed downstream from the swing guide 82 and the conveyance guide 83 in the conveyance direction of the sheet 9. With this configuration, the guide assembly 80 guides the sheet 9 discharged from the fixing device 15 to the output roller pair 24 stably, preventing faulty fixing caused by warping of the sheet 9 precisely.

Referring to FIGS. 5 to 10, the following describes the advantages of the fixing device 15 according to the above-described exemplary embodiments.

As shown in FIG. 5, the fixing device 15, which performs a fixing operation of fixing a toner image 10 on a sheet 9 serving as a recording medium, includes the fixing assembly 46, serving as the fixing rotary body, heated by the heater 52, and the pressing roller 1, serving as the pressing rotary body, separatably pressed against the fixing assembly 46 to form the nip N therebetween through which the sheet 9 bearing the toner image 10 passes.

As shown in FIG. 6, the fixing device 15 further includes the temperature detector 53 disposed opposite the fixing assembly 46 to detect the temperature of the fixing assembly 46 and the temperature controller 54 connected to the temperature detector 53, the heater 52, and the pressing roller 1 to control the temperature of the fixing assembly 46 based on the temperature of the fixing assembly 46 detected by the temperature detector 53 so as to heat the fixing assembly 46 to a plurality of preset target temperatures.

As shown in FIGS. 7 and 9, the plurality of preset target temperatures includes the target normal standby temperature T0 (e.g., the first target standby temperature), the target fixing temperature T1, the target idle temperature T2, and the target high definition standby temperature T3 or T4 (e.g., the second target standby temperature). When the target fixing temperature T1 is lower than the target normal standby temperature T0, the temperature controller 54 separates the pressing roller 1 from the fixing assembly 46 to idle the fixing assembly 46 for the predetermined idle time period P1 before the fixing operation starts. After the fixing operation, the temperature controller 54 controls the heater 52 to change the temperature of the fixing assembly 46 to the target high definition standby temperature T3 or T4 different from the target normal standby temperature T0.

As shown in FIGS. 5 and 6, the temperature detector 53 detects the temperature of the fixing assembly 46; the temperature controller 54 compares the temperature of the fixing assembly 46 detected by the temperature detector 53 with the target temperatures preset by the temperature resister 55, and then controls the heater 52 to heat the fixing assembly 46 to the target temperatures.

For example, if the user selects the high definition mode to fix a high definition toner image 10 on a sheet 9, the pressing roller 1 and the fixing belt 2 of the fixing assembly 46 convey the sheet 9 bearing the toner image 10 through the nip N at a decreased conveyance speed so that the fixing belt 2 can heat the sheet 9 for an increased time period compared to the normal mode that fixes a normal definition toner image 10 on a sheet 9. Under such circumstance, the target fixing temperature T1 is set to be substantially lower than the target normal standby temperature T0. To address this circumstance, the fixing assembly 46 idles for the predetermined idle time period P1 before the fixing operation starts. This is because, if the fixing operation starts while the fixing assembly 46 retains the target normal standby temperature T0, the fixing operation may be performed at the target normal standby temperature T0 higher than the target fixing temperature T1, resulting in overheating of the sheet 9.

To address this problem, the fixing assembly 46 idles for the predetermined idle time period P1 before the fixing operation starts, thus preventing the toner image 10 from being fixed on the sheet 9 at an excessively high temperature.

While the fixing assembly 46 idles, the temperature of the fixing assembly 46 changes from a high temperature equivalent to the target normal standby temperature T0 to a low temperature equivalent to the target fixing temperature T1. Thus, the fixing device 15 fixes the high definition toner image 10 on the sheet 9 stably at the lower fixing temperature. That is, the sheet 9 is not overheated by the fixing assembly 46, maintaining its rigidity. Accordingly, even when the sheet 9 strikes the exit guide 8, the sheet 9 is not deformed by the exit guide 8, preventing faulty fixing caused by bending and warping of the sheet 9.

Further, moisture contained in the sheet 9 is not vaporized by overheating of the sheet 9, preventing vaporized moisture from adhering to an interior of the fixing device 15. Moreover, water droplets do not move with the unfixed toner image 10 on the sheet 9, preventing faulty fixing, such as a spotted toner image and a distorted image, caused by water droplets.

If the fixing assembly 46 is configured to regain the initial standby temperature, that is, the target normal standby temperature T0, immediately after the fixing operation, the fixing assembly 46 needs to idle to decrease its temperature from the target normal standby temperature T0 to the target fixing temperature T1 again so as to perform the next fixing job of the high definition mode.

To address this problem, after the fixing operation, the fixing device 15 gains the standby temperature of the high definition mode, that is, the target high definition standby temperature T3 or T4 different from the target normal standby temperature T0, preventing unnecessary temperature increase of the fixing assembly 46 and therefore saving energy and improving operation efficiency. Further, the fixing assembly 46 idles until its temperature decreases to the target idle temperature T2 higher than the target fixing temperature T1, resulting in a shortened idle time and efficient fixing.

If the target fixing temperature T1 is set to a temperature lower than the target normal standby temperature T0, it is preferable that the fixing device 15 has a mode that changes the conveyance speed at which the fixing assembly 46 and the pressing roller 1 convey the sheet 9 to heat the sheet 9. Accordingly, the fixing device 15 can accommodate smooth switching between the high definition mode and the normal mode to provide stable operation desired by the user.

The temperature detector 53 is disposed opposite the heating roller 4. That is, the temperature detector 53 does not contact the sheet 9. Accordingly, the sheet 9 does not damage the temperature detector 53, minimizing malfunction of the temperature detector 53. Consequently, the temperature detector 53 contacts the fixing belt 2 of the fixing assembly 46 precisely, minimizing temperature error caused by unstable contact of the temperature detector 53 to the fixing belt 2 and stabilizing quality of the toner image 10 fixed on the sheet 9. With the responsive thermistor 6 used as the temperature detector 53, the temperature detector 53 is downsized and manufactured at reduced costs.

The target high definition standby temperature T3 or T4 different from the target normal standby temperature T0 is lower than the target normal standby temperature T0. In addition, it may be equivalent to the target idle temperature T2, lower than the target fixing temperature T1, or higher than the target fixing temperature T1.

The image foaming apparatus 30 installed with the fixing device 15 described above prevents faulty fixing caused by bending and warping of the sheet 9. At the same time, it prevents faulty fixing, such as a spotted toner image and a distorted image, caused by water droplets. Thus, the image forming apparatus 30 forms a high quality toner image 10 on the sheet 9 precisely. Moreover, the image forming apparatus 30 attains efficient operation, thus saving energy and reducing operation costs.

According to the above-described exemplary embodiments, the fixing assembly 46 including the fixing belt 2 is used as a fixing rotary body that rotates in the predetermined direction of rotation; the pressing roller 1 is used as a pressing rotary body disposed opposite the fixing rotary body to form the nip N therebetween and rotating in the direction counter to the direction of rotation of the fixing rotary body. Alternatively, a fixing film, a fixing roller, or the like may be used as a fixing rotary body; a pressing belt or the like may be used as a pressing rotary body, attaining the effects described above.

Further, the fixing device 15 according to the above-described exemplary embodiments is installed in the image forming apparatus 30 serving as a color printer. Alternatively, the fixing device 15 may be installed in monochrome or color image forming apparatuses such as copiers, printers, facsimile machines, and multifunction printers having at least one of copying, printing, scanning, plotter, and facsimile functions, or the like.

Further, according to the above-described exemplary embodiments, the fixing device 15 includes the halogen heater 5 that heats the fixing rotary body. Alternatively, the fixing device 15 may include a radiant heater, an induction heater, or the like, attaining the effects described above.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device that performs a fixing operation of fixing a toner image on a recording medium, comprising:

a fixing rotary body heated by a heater;

a pressing rotary body separatably pressed against the fixing rotary body to form a nip therebetween through which the recording medium bearing the toner image passes;

a temperature detector disposed opposite the fixing rotary body to detect a temperature of the fixing rotary body; and a temperature controller connected to the temperature detector, the heater, and the pressing rotary body to control the temperature of the fixing rotary body based on the temperature of the fixing rotary body detected by the temperature detector so as to heat the fixing rotary body to a plurality of preset target temperatures including a first target standby temperature, a target fixing temperature, a target idle temperature, and a second target standby temperature, wherein, when the target fixing temperature is lower than the first target standby temperature, the temperature controller separates the pressing rotary body from the fixing rotary body to idle the fixing rotary body for a predetermined idle time period before the fixing operation starts, and wherein, after the fixing operation, the temperature controller controls the heater to change the temperature of the fixing rotary body to the second target standby temperature.

2. The fixing device according to claim 1, wherein the fixing rotary body and the pressing rotary body include one of a belt and a roller.

3. The fixing device according to claim 1, further comprising a moving assembly to contact the pressing rotary body to press the pressing rotary body against the fixing rotary body to form the nip threrebetween and separate the pressing rotary body from the fixing rotary body.

4. The fixing device according to claim 1, wherein the temperature detector includes a thermistor.

5. The fixing device according to claim 1, further comprising a temperature register to preset the plurality of preset target temperatures and connected to the temperature controller.

6. The fixing device according to claim 1, wherein the fixing rotary body idles until the temperature of the fixing rotary body decreases to the target idle temperature higher than the target fixing temperature.

7. The fixing device according to claim 1, further comprising a driver connected to the pressing rotary body and the temperature controller to drive and rotate the pressing rotary body, wherein, when the target fixing temperature is lower than the first target standby temperature, the temperature controller controls the driver to rotate the pressing rotary body at a decreased speed.

8. The fixing device according to claim 1, wherein the second target standby temperature is equivalent to the target idle temperature.

9. The fixing device according to claim 1, wherein the second target standby temperature is lower than the first target standby temperature.

10. The fixing device according to claim 9, wherein the second target standby temperature is lower than the target fixing temperature.

11. The fixing device according to claim 9, wherein the second target standby temperature is higher than the target fixing temperature.

12. An image forming apparatus comprising the fixing device according to claim 1.

13. The image forming apparatus according to claim 12, further comprising:

an output roller pair disposed downstream from the fixing device in a conveyance direction of the recording medium discharged from the fixing device; and a guide assembly disposed downstream from the fixing device and upstream from the output roller pair in the conveyance direction of the recording medium to guide the recording medium discharged from the fixing device to the output roller pair.

14. A fixing method for performing a fixing operation of fixing a toner image on a recording medium, comprising:

rotating a pressing rotary body and pressing the pressing rotary body against a fixing rotary body to form a nip therebetween through which the recording medium bearing the toner image passes;

heating the fixing rotary body to a first target standby temperature;

accepting a first fixing job of a high definition mode that forms a high definition toner image on the recording medium;

separating the pressing rotary body from the fixing rotary body to idle the fixing rotary body for a predetermined idle time period until a temperature of the fixing rotary body decreases to a target idle temperature;

pressing the pressing rotary body against the fixing rotary body when the temperature of the fixing rotary body reaches the target idle temperature;

passing the recording medium bearing the toner image through the nip to fix the toner image on the recording medium at a target fixing temperature;

changing the temperature of the fixing rotary body to a second target standby temperature; and increasing the temperature of the fixing rotary body to the first target standby temperature if the fixing device does not accept a second fixing job within a predetermined time period.

15. The fixing method according to claim 14, wherein the target idle temperature is higher than the target fixing temperature.

16. The fixing method according to claim 14, wherein, when the target fixing temperature is lower than the first target standby temperature, the pressing rotary body rotates at a decreased speed.

17. The fixing method according to claim 14, wherein the second target standby temperature is equivalent to the target idle temperature.

18. The fixing method according to claim 14, wherein the second target standby temperature is lower than the first target standby temperature.

19. The fixing method according to claim 18, wherein the second target standby temperature is lower than the target fixing temperature.

20. The fixing method according to claim 18, wherein the second target standby temperature is higher than the target fixing temperature.

* * * * *